United States Patent [19]

Stenzel

[11] Patent Number: 4,639,567

[45] Date of Patent: Jan. 27, 1987

[54] METHOD AND APPARATUS FOR MELTING ROD-SHAPED MATERIAL WITH AN INDUCTION COIL

[75] Inventor: Otto Stenzel, Gründau, Fed. Rep. of Germany

[73] Assignee: Leybold-Heraeus GmbH, Cologne, Fed. Rep. of Germany

[21] Appl. No.: 774,918

[22] Filed: Sep. 11, 1985

[30] Foreign Application Priority Data

Sep. 12, 1984 [DE] Fed. Rep. of Germany ..... 3433458

[51] Int. Cl.[4] ..... H05B 6/40

[52] U.S. Cl. ..... 219/10.43; 219/10.57; 219/10.67; 219/10.79; 266/129

[58] Field of Search ..... 219/10.43, 10.41, 10.57, 219/9.5, 10.79, 7.5, 6.5, 10.67; 266/129; 156/620; 422/250

[56] References Cited

U.S. PATENT DOCUMENTS

| | | | |
|---|---|---|---|
| 2,478,640 | 8/1949 | Roberds | 219/9.5 |
| 2,480,299 | 8/1949 | Klinke | 219/9.5 X |
| 3,096,158 | 7/1963 | Gaulé et al. | 219/10.43 X |
| 3,498,846 | 3/1970 | Keller | 156/620 |

FOREIGN PATENT DOCUMENTS

| | | | |
|---|---|---|---|
| 1069307 | 11/1959 | Fed. Rep. of Germany | 219/10.43 |
| 1012998 | 12/1965 | United Kingdom | 219/10.43 |

*Primary Examiner*—Philip H. Leung
*Attorney, Agent, or Firm*—Felfe & Lynch

[57] ABSTRACT

Method and apparatus for melting rod-shaped material 12. This is continuously displaced in the direction of the rod axis towards an induction coil (5), disposed at the lower end (12*a*) of the rod, which has an opening coaxial with the rod and which is supplied with an alternating current. An induction coil (5) is used of which the axial dimension is several times smaller than the radial dimension. Preferably, a so-called flat-coil is used. The induction coil has an opening (5*c*) which is smaller than the rod diameter. On melting the lower end (12*a*) of the rod is held with its end face at a substantially constant spacing above the induction coil (5). The method and apparatus are suitable for the production of metal powder and for the direct production of shaped parts.

12 Claims, 6 Drawing Figures

METHOD AND APPARATUS FOR MELTING ROD-SHAPED MATERIAL WITH AN INDUCTION COIL

Figure 1:
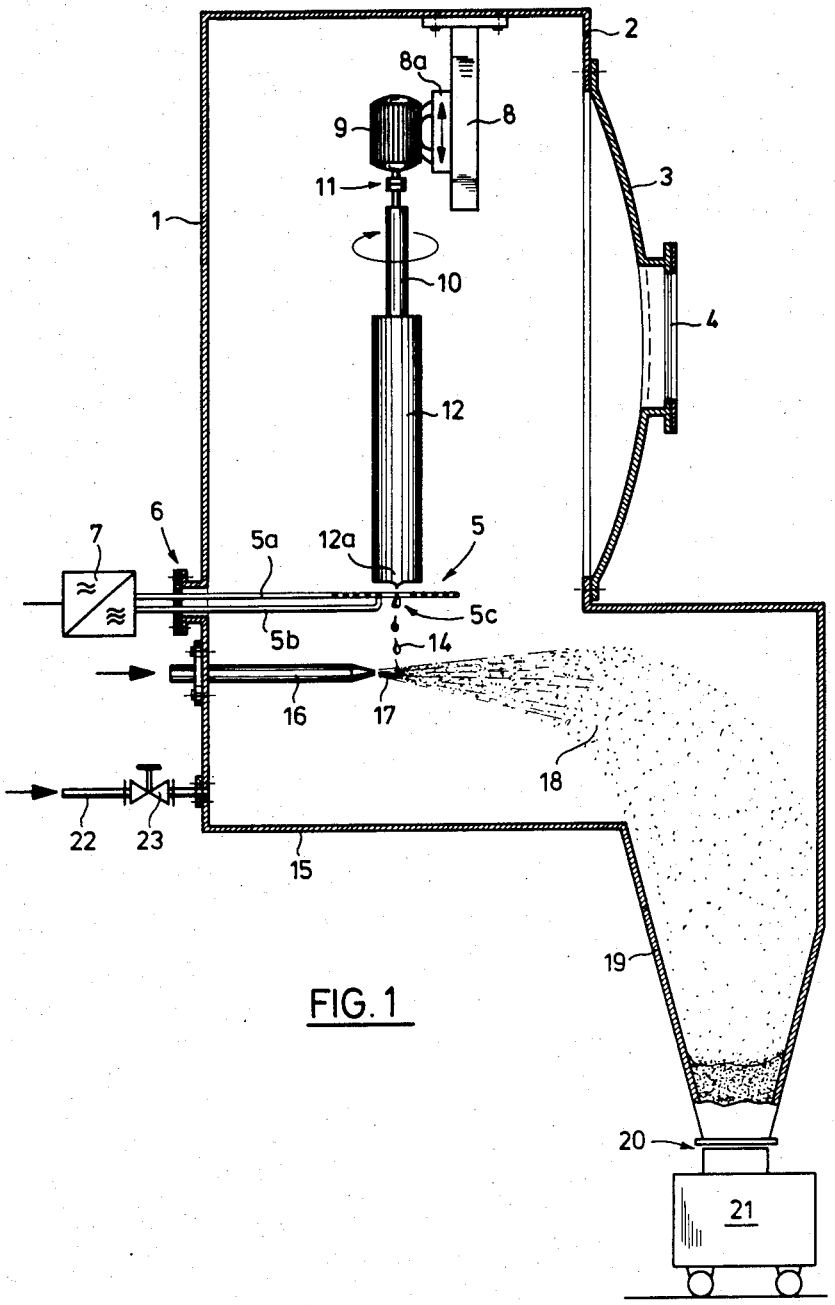

The invention relates to a method for melting rod-shaped material by continuously displacing it in the direction of the rod axis towards an induction coil arranged below the end of the rod, coaxially therewith, supplied with an alternating current and having an opening.

Such a method is carried out in a closed chamber, a so-called melting chamber, and preferably in vacuo and/or in an inert gas. Such an atmosphere not only prevents a reaction of the molten material with reactive atmospheric components, but also makes possible a cleaning of the starting material as well as its conversion to particle and/or block or shaped parts with a quite special crystal structure or form.

Essentially the process of so-called droplet-melting effects under high vacuum a very thorough purification of the starting material, because as a rule the volatile impurities are easily vapourised under the vacuum. The already mentioned droplet-melting satisfies the prerequisites for a favourable surface/volume ratio.

For the method of droplet-melting, the techniques of vacuum arc melting, electron beam melting and inductive melting of rod-shaped material have been used up to now. As the high purity metal produced by the melting process must not be allowed to become impure again, all contact of the melt collected from the dropping process with other materials, especially with ceramic materials, must be completely avoided. For this purpose, the molten particles, whether they are still liquid or partially or completely solidified, are collected in containers with cooled walls. In this collection of the melt, there is formed therefore on the container wall a layer or shell of solidified material which prevents direct contact between the melt and the walls and in the region of the liquid/solid phase transition brings into contact only like materials. For this technology the expression Skull-melting is used internationally.

It is known from U.S. Pat. No. 2,858,586 to guide rod-shaped material, from which on solidification a metal powder is to be produced, into an induction coil, and to collect the dropping melt in a wire casting dish. The induction coil is here substantially wound screw-form, and its inner diameter is at least in the upper part greater than the rod diameter. The rod-shaped material extends into the induction coil and the melt zone extends over a large part of the length of the rod, so that a stream of molten material flows increasingly from above to below along the surface of the rod and separates from the rod in an uncontrolled manner at the lower end of the rod, that is in greater or lesser melt proportions. In practice it could not be observed that the lower end of the rod is so regularly and pointedly shaped as is illustrated therein. It is rather shown that the melt portion is released at different positions from the rod-shaped material and as a result does not always follow the same path. This leads to the fact that a specific transporting of the melt droplets accurately always on the same path is not possible.

From U.S. Pat. No. 3,226,223 is known the combination of melting by electron bombardment and inductive heating. Here too the induction coil is a so-called cylinder coil, that is to say wound screw-fashion, so that its axial dimension is several times larger than its radial dimension. Also in this known solution, the lower end of the rod is inside the induction coil, and the specification referred to shows very much more realistically the different paths of the molten droplets en route from the rod-shaped material to a melt bath from which, in general, through continual lowering of the floor of the bowl, a wire is formed. A uniform molten material stream with an accurately maintained trajectory cannot be produced in the known way.

The term "rod-shaped material" includes the geometry of the starting material insofar as it relates to an elongate body with a substantially constant cross-section (round or polygonal) of which the axis runs substantially vertically during melting. The rod-shaped material can be produced thus by a casting process, by sintering of metal powder or by welding together strip-form material. Using different starting materials with uniform distribution over the length of the rod of the individual components, the melting process produces alloys.

As starting material only special-property alloys, titanium and tungsten are mentioned.

The invention is based on the problem of producing a method of the above referred to description by which the melt is fed from the lower end of the rod in substantially uniform portions and always travels the same trajectory.

The solution of the problem set forth follows from the above described method according to the invention in that the rod-shaped material is displaced towards an induction coil, of which the axial dimension is several times smaller than its radial dimension, of which the opening is smaller than the diameter of the rod, and that the lower end of the rod is maintained with its end face at a substantially constant axial spacing above the induction coil.

An important characteristic of the process is thus the use of an induction coil which can also be designated as a flat coil. The induction coil can thus be formed as substantially a single layer coil with spiral winding, where, by "spiral" is to be understood an Archimedean spiral. The induction coil can, however, also be made with advantage in such manner that the medial line of the winding runs in a wide-angle conical surface with a downwardly directed point. By altering the winding density within the radial dimension of the induction coil the melting effect can be made to have different strengths at different radii.

A further important characteristic is that the opening of the induction coil is smaller than the diameter of the rod and preferably a maximum of 15 mm. This results in that the lower end of the rod is not inside the induction coil but lies over it.

Such an induction coil can also be shown as a plate coil. In international nomenclature, flat coils are also called pancake-coils. Such coils have however not previously been used for inductive droplet melting processes.

By the method according to the invention, the lower end of the rod is melted substantially along a horizontal face. Only in the middle of the rod-like material, namely at the position of the coil opening, a small point is formed which is always located in the same place, namely on the axis of the rod. The point forms a defined position at which the droplets are released, and the inclination of the lower end face of the end of the rod is so small that no undesired strongly accelerated flow can occur.

The induction coil used according to the invention exerts a supporting effect on the melt, so that the lower end of the rod-like material is covered with a thin melt film which drops off the aforementioned point in controlled manner. It deals therefore not only with a purely thermal problem, but the melt drops also on that account from a single position, because the supporting effect of the electromagnetic forces is missing at the relevant position defined by the opening in the coil.

In order to smooth out inevitable inhomogeneities of the electromagnetic forces and the heating effect and those caused by the coil geometry, it is particularly advantageous if according further to the invention the rod-shaped material is rotated on its axis with respect to the induction coil during the melting.

The speed of rotation should not be so great that the melt flies through centrifugal force off the edge of the rod. It has been determined experimentally that the rotational speed of the material should be between 0.5 and 10 $min^{-1}$.

Also in regard to the thickness of the molten surface layer it has been experimentally determined that the induction coil should be supplied with a frequency between 50 and 500 KHz. The frequency is to be chosen by the relationship:

$$f - 10^5 \times \rho[\mu\Omega m]$$

in which the frequency f is given in Hz. "p" is the specific resistance of the material. With superalloys and titanium frequencies between 100 and 200 KHz have been used throughout, for tungsten, a frequency of 50 KHz.

The appropriate frequency choice means that in the axial direction of the rod there is a vertical temperature gradient which makes possible the desired approximately plane and horizontal melt zone at the lower end of the rod.

It is finally with particular advantage possible to modulate the amplitude of the supply voltage to the induction coil, and indeed with especial advantage with a modulation frequency between 1 and 100 Hz. The term "modulation" includes temporarily or completely breaking the current supply circuit.

The modulation of the supply voltage has the result that the output is pulsed and the support for the electromagnetic field is periodically broken, whereby the drop frequency and the superheating of the melt can be influenced.

The invention relates also to an apparatus for carrying out the process according to the invention. This apparatus comprises a melt chamber, an induction coil having an opening and a feed arrangement for displacing, on a vertical axis, rod-shaped material in the direction towards the induction coil coaxial with the rod.

For solving the same problem, this apparatus according to the invention is characterised in that the opening of the induction coil is smaller than the diameter of the rod-shaped material and that the axial dimension of the induction coil is several times smaller than its radial dimension, which in turn is greater than the radial dimension of the rod-shaped material.

So far as, further according to the invention the medial line of the winding lies in a conical surface with a downwardly directed point, wherein the envelope of the conical surface includes an angle up to a maximum 10 degrees to the horizontal, there is produced a melt surface at the lower end of the rod which is inclined less steeply towards the middle. This has the effect that points appearing in the melt surface are covered in higher melting crystals. These points could in some circumstances otherwise become dropping points or even come into contact with the coil, which is extremely undesirable.

Alternatively it is possible to select the winding density in the middle of the coil less than at the edge, whereby is formed likewise a melt surface gently inclined towards the middle.

Finally if one wishes to give additional heat to or re-heat the dropping melt in its further trajectory it is particularly useful to dispose a further substantially cylindrically wound induction coil beneath the opening of the flat induction coil. The internal diameter of the further induction coil corresponds preferably to the diameter of the opening in the flat induction coil.

It is possible, to avoid special leads to both coils, to arrange the coils in series. It is however also possible to provide the two coils with separate connections, so that not only series operation but also parallel operation is possible.

With regard to a further processing of the melt there is the possibility of atomising the individual droplets, by a gaseous medium or a high speed rotating plate, into fine particles or metal powder. It is also possible, however, to collect the dropping melt in a manner designed to produce a desired solidification structure. The melt can for this purpose be deliberately re-heated or already partially crystallised, in order to produce an agglomeration of particles with the formation of an extremely fine structure. Such possibilities will be further explained in the detailed description.

In accordance with the invention, a method for melting rod-shaped material comprises continuously displacing rod-shaped material in the direction of the rod axis towards an induction coil arranged at the lower end of the rod coaxially therewith, supplied with an alternating current and having an opening, the axial dimension of the induction coil being several times smaller than the diameter of the rod, and holding the lower end of the rod with its end face at a substantially constant axial spacing above the induction coil.

Also in accordance with the invention, apparatus for carrying out the above method comprises a melting chamber, an induction coil having an opening and feeding apparatus for displacing a rod-shaped material, held on a vertical axis in the direction of the induction coil which is co-axial with the rod, the induction coil having an opening which is smaller than the cross-section of the rod-shaped material and the axial dimension of the induction coil being several times smaller than its radial dimension, which in turn is greater than the radial dimension of the rod-shaped material.

For a better understanding of the present invention, together with other and further objects thereof, reference is made to the following description, taken in connection with the accompanying drawings, and its scope will be pointed out in the appended claims.

Figure 2:
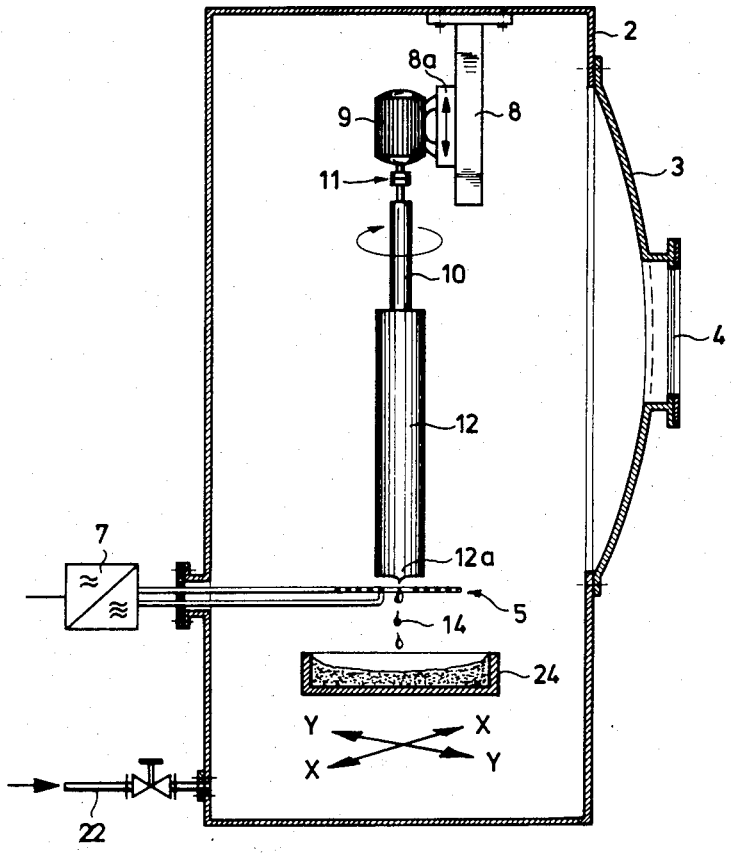

Referring now to the drawings:

FIG. 1 is a schematic, sectional view to represent the operation of the method according to the invention and a correspondingly constructed apparatus for the production of a ceramic-free metal powder;

FIG. 2. is a schematic, sectional view representing the operation of the method according to the invention and an apparatus for the production of a shaped article; and FIGS. 3-6 are fragmentary, schematic, sectional views representing differently formed induction coils and their interaction with the lower end of the rod.

FIG. 1 shows a melting chamber 1, which has a side wall 2 and a door 3 with an observation window 4. There is a spiral wound induction coil 5 in the melting chamber 1 which comprises a metal tube through which a cooling medium flows. The induction coil 5 is connected to a current source 7, which is a medium range frequency generator, by two parallel, radially spaced connectors 5*a* and 5*b* and an insulated mounting 6.

In the upper part of the melting chamber 1 is a feed mechanism 8 with a slider 8*a* which is displaceable in the vertical direction (double arrow). On the slider 8*a* is a rotary drive 9 with which a supporting rod 10 can be set in rotation via a coupling 11. At the lower end of the supporting rod 10 is the rod-shaped material 12 which is to be melted, in the form of a slender cylinder, the axis of which is coincident with the axis of rotation of the rotary drive 9. The rotary drive 9 and the induction coil 5 are so arranged with respect to each other that an opening 5*c* left in the induction coil is precisely coaxial with the axis of rotation. It is also to be noted that the opening 5*c* is in diameter substantially smaller than the diameter of the material 12. It is further to be noted that the outer diameter of the induction coil 5 is markedly greater than the diameter of the material 12.

From this it is seen that for the purpose of uniform melting the spacing of the lower end 12*a* of the rod from the induction coil 5 must be held constant within narrow limits. This can be effected by special distance sensors, not shown, which act on a drive—also not shown here—for the slider 8*a*.

In the manner indicated there is produced at the lower end 12*a* of the rod a point 13, further described in FIGS. 3 to 6, from which a regular stream of vertically falling droplets 14 flows.

According to FIG. 1 the melting chamber 1 projects downwardly into an atomising chamber 15 into which an atomising nozzle 16 opens.

This nozzle is directed exactly at the path of the falling droplets 14 so that a high velocity gas stream 17 from the nozzle 16 is maintained always from the same direction and atomises them into a stream of fine metal particles 18. These metal particles describe, as a result of the impulse they receive from the gas stream 17, a parabolic trajectory, which finally terminates in a shaft 19 which is situated at the side of and directed downwardly from the atomising chamber 15. At the lower end of the shaft 19 is an outlet aperture 21 by which a transportation truck 21 is connectible to the inside of the shaft 19. Another gas conduit 22 opens into the atomising chamber 15 and has a metering valve 23 through which the whole apparatus can be filled with an inert gas. The apparatus can additionally be used under vacuum. The necessary suction arrangement is however not shown for the sake of simplicity.

In FIG. 2 the same parts as in FIG. 1 are shown with the same reference numerals, so that repetition can be avoided. The difference from FIG. 1 consists simply in that instead of the atomising nozzle 16 there is a collecting container 24 beneath the induction coil 5 which is movable as desired along the coordinates X—X and Y—Y. In this manner, the regularly falling droplets 14 are distributed in a predetermined pattern in the collecting container 24, so that a quite specific structure can be produced there. It is thereby possible for example to introduce the droplets 14 in an already partially crystallised state into the collecting container 14, whereby they adhere to one another but retain the fine crystal structure of the droplets. Such a method can for example be used directly to produce turbine discs which can be subsequently mechanically compacted by a pressing process.

Figure 3:
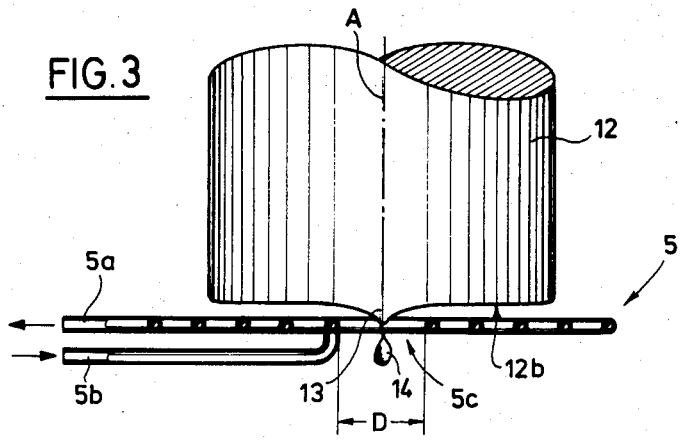

FIG. 3 shows an induction coil 5 of which the single winding is made in the form of an equally spaced Archimedean spiral. The lengthwise axis of the winding thus lies in a horizontal plane. The innermost turn defines the opening 5*c* of the coil, which has a diameter D of 15 mm maximum. Through the interaction of this induction coil 5 with the material 12 there is formed on the lower end face 12*b* a molten surface which at least in the edge region can be described as approximately horizontal or radial. Only in the middle, that is to say on the lengthwise axis A of the material 12, is the already described point 13 formed, from which the droplets 14 fall in constant succession.

Figure 4:
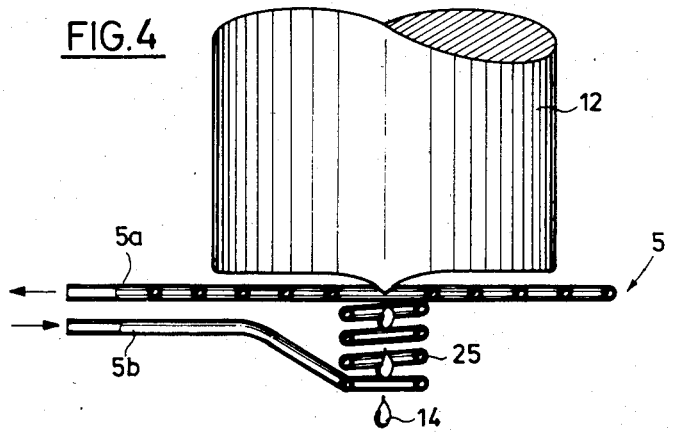

FIG. 4 differs from FIG. 3 only insofar as a further cylindrical or screw thread wound induction coil 25 is connected beneath the induction coil 5, in which the falling droplets 14 can be re-heated. The internal diameter of the induction coil 25 is somewhat smaller than the diameter D of the opening 5*c* in the induction coil 5. The two coils are electrically connected in series, i.e. they can be connected with the current source 7 by the same terminals. As already mentioned, it is however also possible to make a parallel connection by means of additional terminals.

Figure 5:
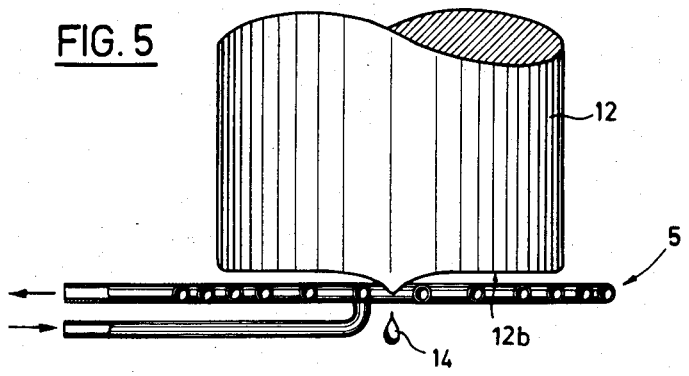

FIG. 5 shows an arrangement like FIG. 3 but with the difference that the winding density of the induction coil 5 is smaller at the middle of the coil than at the edge. This means that the number of turns per unit radial length at the edge of the coil is greater than in the middle. This leads to a greater heat generation and supporting effect at the edge of the coil so that a slight gradient is produced on the lower end face 12*b*.

Figure 6:
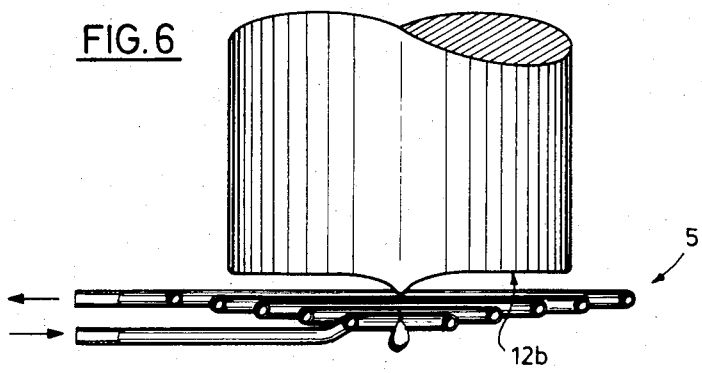

FIG. 6 shows an induction coil 5 in which the medial line of all the windings lies in a wide-angle conical surface of which the point is directed downwardly. Otherwise, however, the individual windings are equidistant. In this way is obtained an effect analogous to that with the induction coil of FIG. 5, namely that on the end face 12*b* there is a slight gradient, which has the result more particularly described above.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A method for drip-melting rod-shaped material comprising:

continuously displacing rod-shaped material in the direction of the rod axis towards an induction coil arranged at the lower end of the rod coaxially therewith, supplied with an alternating current and having an opening, the axial dimension of the induction coil being several times smaller than the diameter of the rod-shaped material, and causing melt of the rod-shaped material freely to fall in liquid form through the opening of the induction coil by holding the lower end of the rod-shaped material with its end face at a substantially constant axial spacing above the induction coil.

2. A method according to claim 1, which includes rotating the rod-shaped material about its axis during the melting.

3. A method according to claim 2, which includes rotating the material at between 0.5 and 10 revolutions per minute.

4. A method according to claim 1, which includes supplying the induction coil with a current at a frequency of between 50 and 500 KHz.

5. A method according to claim 4, in which the amplitude of the supply voltage to the induction coil is modulated.

6. Method according to claim 4, in which the frequency of the modulation is between 1 and 100 Hz.

7. The combination of a rod-shaped material having an axial drip-melt point and having material surrounding the axial drip-melt point and apparatus for drip-melting the rod-shaped material comprising a melting chamber, an induction coil having an opening and a feeding apparatus displacing a rod-shaped material having an axial drip-melt point and having material surrounding the axial drip-melt point, held on a vertical axis in the direction of the induction coil which is coaxial with the rod-shaped material, and said feeding apparatus maintaining the material surrounding the axial drip-melt point above the induction coil, the induction coil having an opening which is smaller than the cross-section of the rod-shaped material and the axial dimension of the induction coil being several times smaller than its radial dimension, which in turn is greater than the radial dimension of the rod-shaped material.

8. The combination according to claim 7, in which the maximum diameter of the opening is 15 mm.

9. The combination according to claim 8, in which the induction coil is formed as a substantially flat, one layer coil with spiral winding.

10. The combination according to claim 9, in which the medial line of the winding lies in a wide-angle conical surface with its point directed downwardly.

11. The combination according to claim 9, in which the winding density at the center of the coil is less than at the edge of the coil.

12. The combination according to claim 7, which includes, beneath the opening of the flat induction coil, a further induction coil with a substantially cylindrical winding for re-heating the melt.

* * * * *